United States Patent [19]

Wright et al.

[11] Patent Number: 4,759,688

[45] Date of Patent: Jul. 26, 1988

[54] COOLING FLOW SIDE ENTRY FOR COOLED TURBINE BLADING

[75] Inventors: E. Scott Wright, Mesa; Chester L. Henry, Tempe, both of Ariz.

[73] Assignee: Allied-Signal Inc., Morris Township, Morris County, N.J.

[21] Appl. No.: 942,316

[22] Filed: Dec. 16, 1986

[51] Int. Cl.[4] ..... F01D 3/02

[52] U.S. Cl. ..... 416/95; 416/96 R; 416/96 A; 415/115; 415/116

[58] Field of Search ..... 415/115, 116; 416/95, 416/96 R, 96 A

[56] References Cited

U.S. PATENT DOCUMENTS

| | | | |
|---|---|---|---|
| 2,910,268 | 10/1959 | Davies et al. | 416/95 |
| 2,988,325 | 6/1961 | Dawson | 415/115 |
| 3,043,561 | 7/1962 | Scheper | 415/115 |
| 3,565,545 | 2/1971 | Bobo et al. | 416/95 |
| 3,602,605 | 8/1971 | Lee et al. | 415/116 |
| 3,635,586 | 1/1972 | Kent et al. | 415/115 |
| 3,748,060 | 7/1973 | Hugoson et al. | 416/95 |
| 3,791,758 | 2/1974 | Jenkinson | 415/115 |
| 3,814,539 | 6/1974 | Klompas | 416/95 |
| 3,832,090 | 8/1974 | Matto | 416/95 |
| 3,853,425 | 12/1974 | Scalzo et al. | 416/95 |
| 3,936,215 | 2/1976 | Hoff | 415/115 |
| 3,990,812 | 11/1976 | Radtke | 415/115 |
| 4,086,757 | 5/1978 | Karstensen et al. | 415/115 X |
| 4,113,406 | 9/1978 | Lee et al. | 415/115 |
| 4,178,129 | 12/1979 | Jenkinson | 416/95 |
| 4,187,054 | 2/1980 | Landis et al. | 415/115 |
| 4,292,008 | 9/1981 | Grosjean et al. | 415/115 |
| 4,425,079 | 1/1984 | Speak et al. | 416/95 |
| 4,447,190 | 5/1984 | Campbell | 416/95 |
| 4,453,888 | 6/1984 | Hovan et al. | 416/96 R |
| 4,456,427 | 6/1984 | Evans et al. | 416/95 |
| 4,541,774 | 9/1985 | Rieck et al. | 415/115 |
| 4,657,482 | 4/1987 | Neal | 415/115 |

FOREIGN PATENT DOCUMENTS

| | | | |
|---|---|---|---|
| 777612 | 11/1955 | United Kingdom | 416/96 |
| 2168760A | 6/1986 | United Kingdom | 416/95 |

*Primary Examiner*—Robert E. Garrett
*Assistant Examiner*—Therese Newholm
*Attorney, Agent, or Firm*—James W. McFarland

[57] ABSTRACT

Method and apparatus for delivering cooling fluid flow to the internal blade cooling passages in a gas turbine engine, wherein cooling flow is injected into a radial side face of the hub of the turbine wheel and is ported therefrom through internal passages in the hub to the blade internal cooling passages.

2 Claims, 2 Drawing Sheets

FIG. 4
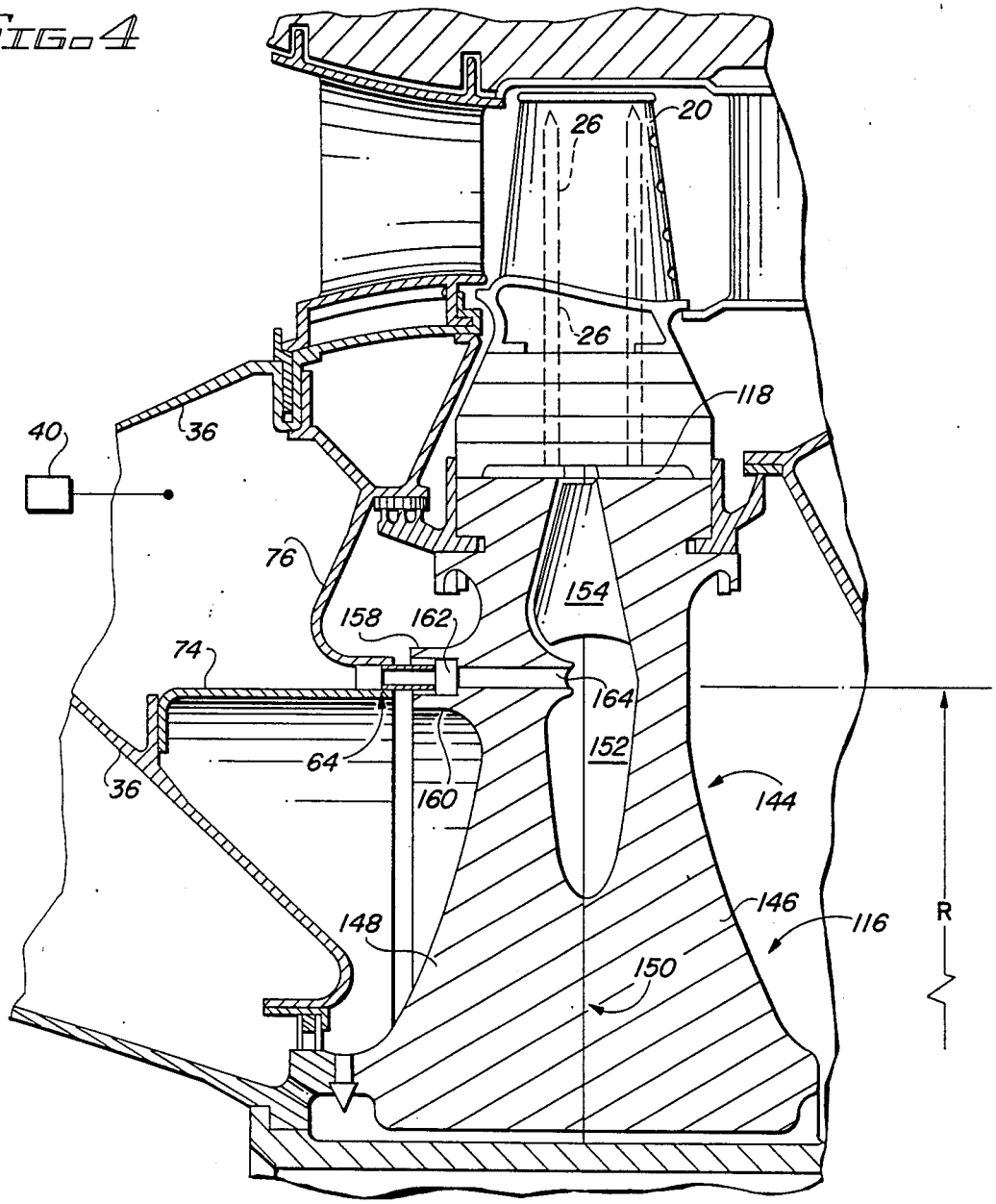
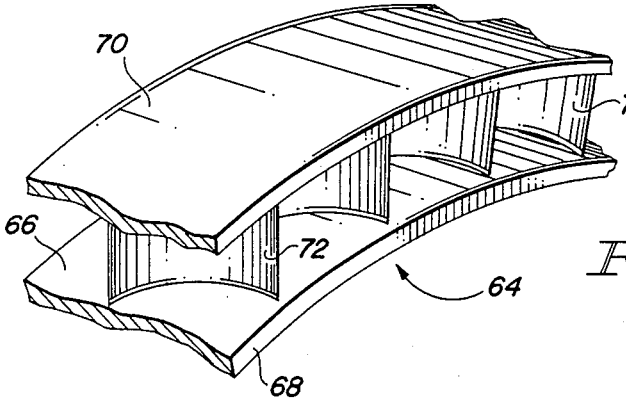
FIG. 3

COOLING FLOW SIDE ENTRY FOR COOLED TURBINE BLADING

BACKGROUND OF THE INVENTION

The invention relates to gas turbine engines, particularly the internal cooling of turbine blades, and to improved method and apparatus for delivery of cooling air to the blades.

In essence, a gas turbine engine comprises a compression stage in which air is pressurized. Pressurized air is sent to a combustion chamber where it is mixed with fuel and the mixture is ignited. The combustion gases produced by the ignition of the air/fuel mixture is a hot, rapidly expanding gaseous volume which is directed from the combustion chamber to a turbine wheel to drive the latter.

In order to achieve efficiency available with higher temperature gas turbine engine operation, the turbine rotor blades are effectively and efficiently cooled. The prior art has provided rotor blades with internal passages. Cooling fluid is injected into these internal cooling passages or channels, flows through the interior of the blade and exits therefrom to provide additional surface cooling of the blades. This arrangement is disclosed in greater detail in U.S. Pat. No. 4,270,883, assigned to the same assignee herein, issued Jan. 2, 1981; made a part hereof by reference.

When considering the addition of apparatus to cool the rotor blades of a turbine engine, the operational speed at which parts of the engine move must be given due consideration. For example, the rotor blades move in a circular path as the rotor rotates. Within as little as one second, the tip of each rotor blade may travel 2,000 feet or more. Under such dynamic conditions it is of utmost importance that the structural integrity of the rotor/rotor blade assembly be maintained.

In general, the coolant fluid employed in a gas turbine engine will be air derived from the compression stage. The more air that is drawn off for cooling purposes, the less air available for use in the combustion chamber. The most efficient cooling system will draw the least amount of air from the compressor. Once air has been drawn from the compressor for use as a coolant, it is an important function of the cooling system that losses, both fluid and mechanical, be minimized.

Cooling fluid flow losses are generally attributable to insertion losses and pumping losses. Pumping losses result from the energy taken from the rotor as it works to move coolant fluid from the radius at which it is injected on or into the rotor outward to the radius of the rotor blades, at the periphery of the rotor.

Insertion losses are made up of seal losses, frictional losses, and swirl losses. In directing coolant fluid from one place to another, the fluid may move from regions having stationary elements to those having rapidly rotating elements. Because of the high speed of rotation of these latter elements, the seals employed between stationary and moving parts generally comprise labyrinth structures which impede the flow of coolant fluid through them by providing a high impedance, tortuous fluid-flow-path. However, the structure is basically a leaky one and becomes more so as the pressure of the fluid impinging on the seal increases.

Seal losses are minimized by minimizing the static pressure of the fluid impinging on the seals. Reduction of seal losses, in turn, reduces the amount of air that must be supplied by the compressor stage. For a given compressor stage, there is more air available for combustion purposes when seal losses are minimized.

Frictional losses result from the interaction of the rotational elements of the engine with the coolant fluid. Frictional losses reduce the efficiency of cooling by raising the temperature of both the coolant and the moving parts, and by decreasing the coolant's pressure. Thus, when frictional losses are significant, a higher initial coolant pressure is required. This higher pressure increases the burden on the seals and an increased seal loss derives.

Swirl losses are caused when the rotor, rotor blades, or other rotating parts of the turbine engine have to impart energy to the coolant to accelerate the coolant fluid such that the coolant itself acquires a rotational velocity or swirl equal to that of the rotor or other rotating part. This places a load on the rotating parts, raises the temperature of the coolant fluid and reduces the shaft energy available from the turbine engine.

An optimum cooling system will minimize insertion losses (seal, frictional and swirl) and pumping losses by minimizing the work done in moving coolant fluid into the rotor blades, all the while maintaining structural integrity of the rotor. The art in this area has concentrated for the most part on a single approach to more efficiently supply cooling air to turbine blades, namely, by imparting some degree of swirl to the cooling air before it is supplied to the turbine rotor, thereby minimizing some portion of the insertion losses. This technique will reduce swirl loss, for, if it is performed effectively, the cooling air is brought to a tangential velocity equaling the tangential velocity of the turbine rotor at the point at which the cooling air is supplied to the turbine rotor.

An early reference utilized this approach is U.S. Pat. No. 2,910,268 to Davies et al., which is an apparatus for tapping air from a compressor section of a turbine engine and providing it to the interior portion of the shaft of a turbine rotor. Succeeding references have further improved the techniques of preswirling the cooling air so as to reduce some components of insertion losses including swirl loss. Such references include U.S. Pat. Nos. 2,988,325; 3,602,605; and 3,936,215. By preswirling the cooling air, insertion losses are reduced somewhat. Additionally, the preswirling effectively presents nozzles through which the cooling flow expands to reach rotor speed at a lower pressure and temperature.

These devices all possess significant problems in delivering the cooling air to the turbine blades in that they require a primary design choice to be made. If cooling air is supplied at high pressure to the turbine rotor, there is a substantial leakage problem resulting in the loss of a significant percentage of the cooling air and resulting in reduced efficiency in the cooling operation. The other alternative involves supplying cooling air at a somewhat lower pressure and utilizing a pumping vane to move the air from the interior of the turbine rotor outward to the turbine blade. This technique necessarily involves performing a substantial amount of work on the cooling air, decreasing the efficiency of the cooling operation and causing drag on the turbine wheel as well as increasing the temperature of the cooling air supplied to the turbine blades. An example of such a pumping blade is shown in U.S. Pat. No. 3,602,605 to Lee et al.

Very high speed rotating turbomachinery has yet further trade-offs in structural design considerations for delivering cooling flow to rotating, internally cooled turbine blading. Specifically, the optimal radius for injecting cooling flow into the turbine rotor oftentimes lies between the central bore of the rotor and its outer periphery where the turbine blading is located. Because of the high rotational speed of the rotor, however, in smaller gas turbine machinery the necessarily rotating support structure for defining an entry for the cooling flow at the optimal radius must be quite heavy and bulky in order to withstand the high centrifugal loads thereon. This results in added weight and dramatically increased mechanical complexity for the smaller gas turbine engine.

Additionally, it has been found that such rotating support structure must be axially offset somewhat from the rotating turbine in order to provide the required strength to these rotating elements. As a result, the cooling flow is then necessarily injected into a relatively large, open cavity wherein various aerodynamic losses occur to the cooling flow before it can find its way to the passages ultimately leading to the internal turbine blade cooling passages.

SUMMARY OF THE INVENTION

Accordingly, an important object of the present invention is to provide improved method and apparatus for delivering cooling flow, particularly for high speed rotating gas turbine machinery, wherein the cooling flow is ported directly into a radially extending sideface of the hub of the turbine rotor, and then proceeds internally within the hub to the outer periphery thereof to reach the internal passages within the turbine blading.

More particularly, the present invention contemplates a turbine hub structure made of a plurality of separate elements, or otherwise constructed to present a unitary rotating hub section having internal cavities therewithin. Additionally, an annular channel or groove on one sideface of the hub is in fluid communication with the internal cavity. A stationary, annular nozzle fits within the annular channel on the sideface of the hub for directing cooling flow thereinto in a most efficient and economical manner, thereby eliminating the heavy, rotating support structure normally associated with high speed, smaller gas turbine machinery.

These and other objects and advantages of the present invention are specifically set forth in or will become apparent from the following detailed description of a preferred arrangement of the invention, when read in conjunction with the accompanying drawings.

BRIEF DESCRIPTION OF THE DRAWINGS

FIG. 3 is a partial perspective view of the annular stationary nozzle for delivering cooling flow to the turbine wheel of FIG. 1; and FIG. 4 is a partial longitudinal cross-sectional view, similar to FIG. 1, but showing an alternate embodiment of the present invention.

DETAILED DESCRIPTION OF THE PREFERRED EMBODIMENT

Figure 1:
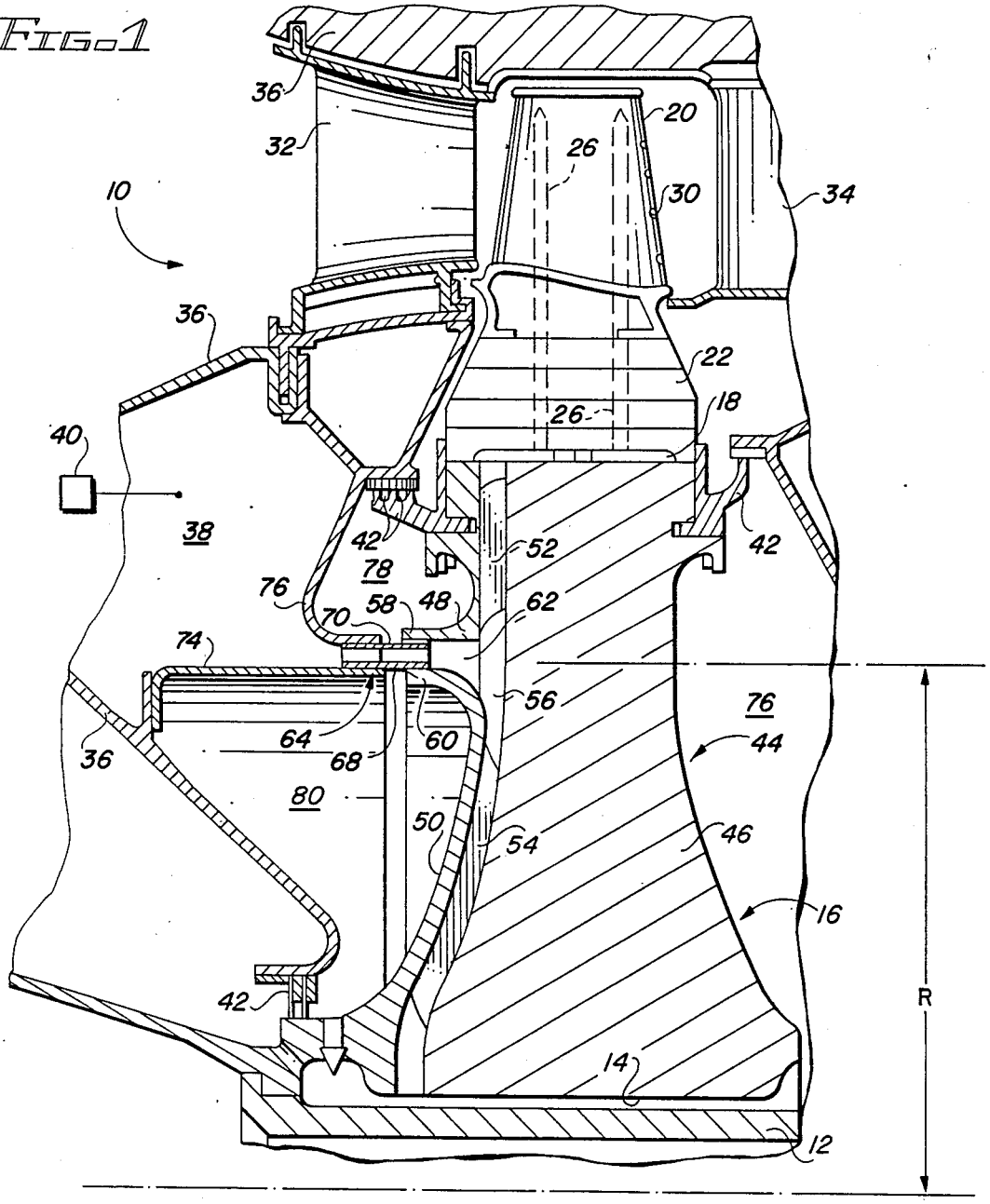
FIG. 1 is a partial longitudinal cross-section of a portion of a gas turbine engine as contemplated by the present invention, with the peripheral turbine blading shown in full section.
Figure 2:
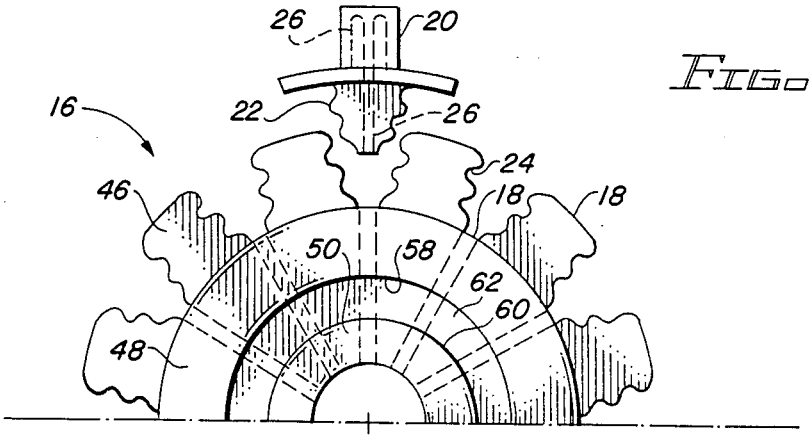
FIG. 2 is a partial front plan view of the turbine rotor construction illustrated in FIG. 1, with the peripheral internally cooled turbine blading exploded slightly therefrom for clarity of illustration.

Referring now more particularly to FIGS. 1-3, a portion of a high speed rotating gas turbine engine 10 is illustrated, having a drive shaft 12 extending through the central bore 14 of a turbine rotor stage 16. Rotor 16 includes along its outer periphery 18 a plurality of internally cooled turbine blades 20 which are disposed circumferentially about the periphery of wheel 16. As conventional, the blades 20 have a dove-tail or fir-tree like base 22 which fits within corresponding fir-tree or dove-tail configured openings 24 along the outer periphery 18 of the turbine wheel 16. Internal cooling passages 26 within the blade portion per se of blades 20 extend downwardly through the dove-tail base section 22 to the outer periphery 18 of the turbine wheel. Cooling flow delivered to internal passages 26 ultimately exits the blades 20 through openings such as those illustrated at 30 in FIG. 1.

Wheel 16, along with the peripheral blades 20 is mounted in torque transmitting relationship to the shaft 12 near the central bore 14 of the wheel. Illustrated in FIG. 1 is certain surrounding stationary structure of the gas turbine engine including vanes stator 32 and 34 respectively upstream and downstream of the turbine wheel 16, along with the adjacent mounting structure 36 for defining the primary path for high temperature hot gas flow across the turbine blades 20. Additionally, the stationary support structure 36 defines a space 38 within the engine wherein a cooling flow of pressurized fluid is introduced from a source from the engine illustrated diagrammatically by element 40. Conventional sealing arrangements as at 42 are also illustrated in FIG. 1.

Turbine rotor 16 includes a hub section 44 which may be made of wrought super alloy material to withstand the high centrifugal loading imposed thereupon. As contemplated by the present invention, the hub section 44 is comprised of a plurality of separate elements. In the FIG. 1 arrangement, the three elements comprising hub 44 include elements 46, 48 and 50. Element 46 presents the primary structure of the hub, while elements 48 and 50 are both of annular configuration which are separately, permanently intersecured to element 46 such as by diffusion bonding. More particularly, element 48 which is disposed radially outwardly and concentrically to element 50, is illustrated with a plurality of axially extending support structures 52, the opposite end of which are diffusion bonded to element 46 such that elements 46 and 48 are permanently intersecured. Similarly, element 50 may include a plurality of support elements 54 extending axially to be diffusion bonded to element 46.

Importantly, the three elements 46, 48 and 50 are so relatively configured and arranged so as to define an internal cavity means 56 within the hub section 46 that extends generally radially outwardly to the outer periphery 18 of the hub section 46. From the outer periphery the internal cooling cavity 56 communicates with the internal cooling passages 26 of the turbine blades 20.

Importantly, the elements 48 and 50 each have axially extending, upstanding walls 58 and 60 which extend annularly around the hub section 46 so as to define a continuous, annular channel 62 therebetween. Channel 62 extends directly inwardly to open into internal cooling cavity 56. Walls 58 and 60 are radially located so as to define the annular channel 62 at a preselected optimal radius R as described in greater detail below.

Stationary support structure 36 provides stationary support for an annularly configured, ring-like nozzle assembly 64 disposed adjacent channel 62. More particularly, nozzle assembly 64 (illustrated in greater detail in FIG. 3) is a continuous annular circular ring defining nozzle passages 66 between radial inner and outer walls 68 and 70. Preferably, a plurality of preswirl vanes 72 extend radially across nozzle space 66. Nozzle assembly 64 is securely mounted to stationary structure such as elements 74 and 76 in FIG. 1 so as to receive the cooling fluid flow from space 38 and direct the latter into cooling channel 62 of hub section 46.

Thus, the structure of the present invention provides an inlet nozzle that is stationary, but which fits within the rotating annular channel 62 so as to deliver cooling flow directly into the interior of the hub section 44 of the turbine wheel. In this manner the present invention eliminates the axially offset coverplate which is normally associated with the turbine stage of a high speed gas turbine engine to provide the necessary support structure for delivery of cooling air flow to the cooled turbine blades 20.

In the preferred arrangement, the blades 72 act as preswirl vanes for imparting a rotary swirl to the incoming cooling air flow such that its tangential velocity approximates the tangential velocity of the rotor hub at the channel 62 in order to minimize insertion fluid losses. Similarly, in a preferred arrangement the support structure 52 may present a plurality of pumping vanes aerodynamically configured in order to provide pumping assistance in driving the cooling air flow efficiently radially outwardly to the outer periphery of the hub section 46. This further minimizes aerodynamic losses to the cooling flow while providing cooling flow at a sufficient pressure to adequately cool the turbine blades 20.

Also, preferably, the support structure 54 may be aerodynamically configured such that a certain amount of cooling air flow in cavity 56 passing radially inwardly across structure 54 imparts torque to assist in rotatively driving wheel 16. In this manner the flow across structure 54 tends to reintroduce into the turbine wheel 16 a certain amount of the rotating energy which is lost in structure 52 in pumping the cooling flow radially outwardly. In the arrangement illustrated in FIG. 1, the portion of cooling flow in cavity 56 which passes radially inwardly across structure 54 may be discharged into central bore 14 for passage therealong for secondary cooling in the zone 76 behind wheel 16.

Preferably, the walls 68 and 70 of the nozzle assembly 64 fit relatively closely to the adjoining walls 58 and 60 of elements 48 and 50. However, in a preferred arrangement, sealing means are not required between these adjacent walls. The channel 62 is relatively slightly overpressurized in comparison to the spaces 78 and 80 such that any leakage of cooling flow out of channel 62 acts as a secondary cooling flow source for the spaces 78 and 80 within the engine.

In operation of the FIG. 1 embodiment, hot combustion gas from the engine is directed across stationary vanes 32 to flow across blades 20 and rotate the turbine wheel 16. Cooling fluid flow from the source 40 is pressurized and directed into space 38 for subsequent discharge through the nozzle assembly 64 and across the preswirl vanes 72 to enter the rotating annular channel 62 of the hub section at the optimal radius R in a highly efficient manner. The cooling flow in channel 62 passes through the internal cavity 56 within hub section 46 for subsequent delivery to the internal cooling passages 26 within the blade for efficient cooling thereof. As noted, a portion of this cooling flow may pass radially inwardly to the central bore 14 for secondary cooling purposes.

Referring now to FIG. 4, an alternate arrangement for the hub section is illustrated. More particularly, turbine wheel 116 has an outer periphery 118 configured as wheel 16 of FIG. 1, for receiving the blades 20 for receiving the cooled blades 20. Adjacent one radial face of wheels 116 is like support structure 36, 74 and 76 as illustrated in FIG. 1 for supporting and positioning the same nozzle assembly 64 as previously described.

In contrast to the FIG. 1 arrangement, the hub section 144 of the turbine wheel 116 is comprised of only two sections 146,148 rather than the three sections of the hub section of the wheel FIG. 1. The two elements 146,148 are diffusion bonded together along a radial joining plane 150, and are so configured so as to define an internal cooling cavity 152 within the interior of hub section 144. Element 148 has defined on the external face thereof a pair of walls 158,160 for defining a continuous annular channel 162 therebetween. Accordingly, it will be seen that the continuous annular channel 162 may receive preswirled cooling air flow from the stationary nozzle assembly 64 as was described previously with respect to the FIG. 1 embodiment.

The continuous annular channel 162 communicates with the internal cavity 152 through a plurality of drilled holes or ducts 164. In this manner it will be seen that cooling air flow from space 38 is delivered ultimately to the internal cooling cavity 152 for radially outward flow to the cooling passages 26 of the cooled turbine blades as described with respect to FIG. 1. Preferably, the other element 146 may include a plurality of pumping vanes 154 extending axially across the internal cavity 152 in order to impart additional energy for efficiently delivering the cooling air flow to the outer periphery 118 of the hub section 144. As desired, the internal cooling cavity 152 may be so configured so as to extend radially inwardly from channel 162 in order to reduce the mass of the rotating turbine wheel 116.

In both FIGS. 1 and 4 radius R refers to the radius at which the injector nozzle 64 and the inductor channel 62,162 is located with respect to the longitudinal rotary axis of the turbine engine. As those skilled in the art will readily understand, the selection of the radius R will affect the static pressure, the dynamic pressure, and the temperature of the coolant injected into the interior cooling channels 26 of rotor blades 20. These various interactions must be borne in mind by those skilled in the art when selecting the radius R.

Those skilled in the art will recognize that, as the coolant enters cooling channels 26 in the interior of blades 21, a designated static pressure will be required to move the air into and through the cooling channels 26. The smaller the radius R, the greater the velocity component or dynamic pressure required to cause the coolant to arrive at the entry point of channels 26 at the base of rotor blades 20. The static pressure at the output of injector nozzle 64 should be reasonably low so as not to overstress any labyrinth seals in the system. The volume of air flow per unit time, sometimes referred to as dynamic pressure, must not be so great as to cause a back pressure to build up within channel 62,162.

The coolant channel volumetric capacity decreases as the radius R approaches closer to the longitudinal axis. Thus, locating channel 62,162 closer to the longitudinal axis has the effect of decreasing the volume flow capacity of coolant through inductor nozzle 64 since the channels 62,162 are of reduced volumetric capacity closer to the axis.

Coolant flowing through injector nozzle 64 and around swirl vanes 72 experiences a decrease in temperature as the velocity component, the dynamic pressure, of the coolant increases. Thus, the velocity component of the coolant, which is in turn affected by the initial injection pressure of the coolant into injector nozzle 64, should be selected to yield the lowest available temperature for the conditions of operation.

These conditions of operation include the available total pressure and volume of coolant flow available at the input to injector nozzle 64. All of these factors, then, must be considered by one practicing the invention in order to achieve the desired, swirled condition of the coolant flow. Those skilled in the art will recognize that the entire process is an iterative one.

What has been disclosed is a rotationally swirled axially directed cooling fluid flow system for use in a gas turbine engine. Coolant is directed in an axial direction while swirled tangentially to the direction of rotor motion. A continuous annular inductor or channel 62,162 inducts coolant into internal cavity 56,152 on the rotor of the engine so as to cause the coolant to be ducted to interior cooling passages 26 within the rotor vanes. A continuous annular injector or nozzle 64 located in juxtaposition to the continuous annular inductor provides an efficient means for injecting the coolant into the continuous inductor in such a manner that the coolant travels in a rotary path while the coolant maintains an axially directed impetus to move the swirling coolant toward the rotor.

Having described our invention in such a clear and concise manner in the foregoing drawings and specification that those skilled in the art may readily practice the invention, that which we claim is:

1. A gas turbine engine comprising:

a turbine rotor having a central hub section extending radially from an axially extending central bore to an outer periphery, and a plurality of turbine blades secured to said outer periphery and disposed circumferentially therearound, said blades having internal cooling passages opening onto said outer periphery of the hub section;

said hub section comprised of a plurality of permanently intersecured elements configured and relatively arranged to define a radially extending internal cavity means within said hub section opening onto said periphery thereof for delivering cooling fluid flow to said internal cooling passages of said blades;

at least one of said elements defining a pair of axially extending, radially spaced circular walls on an external surface of said hub section radially intermediate said central bore and said outer periphery to present a continuous annular channel disposed between said pair of walls and concentric with said bore, said hub section configured whereby said annular channel opens into said internal cavity means;

rotary shaft means disposed in said central bore in torque transfer interengagement with said hub section;

annular stationary nozzle means extending into said continuous annular channel for delivering cooling fluid flow thereinto;

said internal cavity means extending radially from said channel to said outer periphery, and further defining inward passages extending radially inwardly from said channel to open into said central bore;

said hub section being comprised of first, second, and third of said elements, said first and second elements being permanently secured to a radial face of said third element, said first and second elements being annular and said first element disposed radially outwardly of and concentric to said second element, said first and second elements having adjacent annular walls defining said channel therebetween; and inner supports extending axially across said inward passages from said second to said third element.

2. A gas turbine engine as set forth in claim 1 wherein said inner supports are configured whereby cooling fluid flow thereacross assists in rotatively driving said rotor.

* * * * *